United States Patent [19]

Hutchinson

[11] Patent Number: 4,885,899

[45] Date of Patent: Dec. 12, 1989

[54] COMPACTING MACHINE

[76] Inventor: Roy E. Hutchinson, 40 McKay Road, Dundas, Ontario, Canada, L9H 1H7

[21] Appl. No.: 114,127

[22] Filed: Jan. 21, 1980

[51] Int. Cl.[4] ..... B65B 1/24; B65B 7/20

[52] U.S. Cl. ..... 53/527; 53/374

[58] Field of Search ..... 53/374, 527, 286, 221, 53/222, 223; 100/229 A, 250

[56] References Cited

U.S. PATENT DOCUMENTS

| | | | |
|---|---|---|---|
| 2,609,646 | 9/1952 | Total | 53/223 |
| 2,876,607 | 3/1959 | Shaw et al. | 53/374 |
| 3,032,947 | 5/1962 | Voller | 53/374 X |
| 3,384,007 | 5/1968 | Boje et al. | 53/527 X |
| 3,633,329 | 1/1972 | Nadler | 53/527 X |
| 3,808,766 | 5/1974 | Hutchinson et al. | 53/527 X |
| 3,942,430 | 3/1976 | Day et al. | 53/527 X |
| 4,051,955 | 10/1977 | Kaffka | 53/527 X |

*Primary Examiner*—John Sipos

*Attorney, Agent, or Firm*—Diller, Ramik & Wight

[57] ABSTRACT

This disclosure is directed to a compacting machine for compacting material in a carton having closure flaps and includes a housing defining an elongated compacting chamber in which reciprocates a ram for compacting material within the carton when the carton is disposed with its flaps folded exteriorly thereof, a door through which a carton and the material compacted therein can be discharged from the compacting chamber, and a plurality of fingers which are operative during the discharge motion of the carton to effect the folding of the carton flaps to a closed position. The compacting machine further includes a venturi-like passage which receives a ram head having spring biased relatively movable opposite sides, and the ram head being guided during its movement in a direction to compact the material and carrying a panel for closing an opening through which material which is to be compacted is deposited in the compacting chamber.

13 Claims, 5 Drawing Sheets

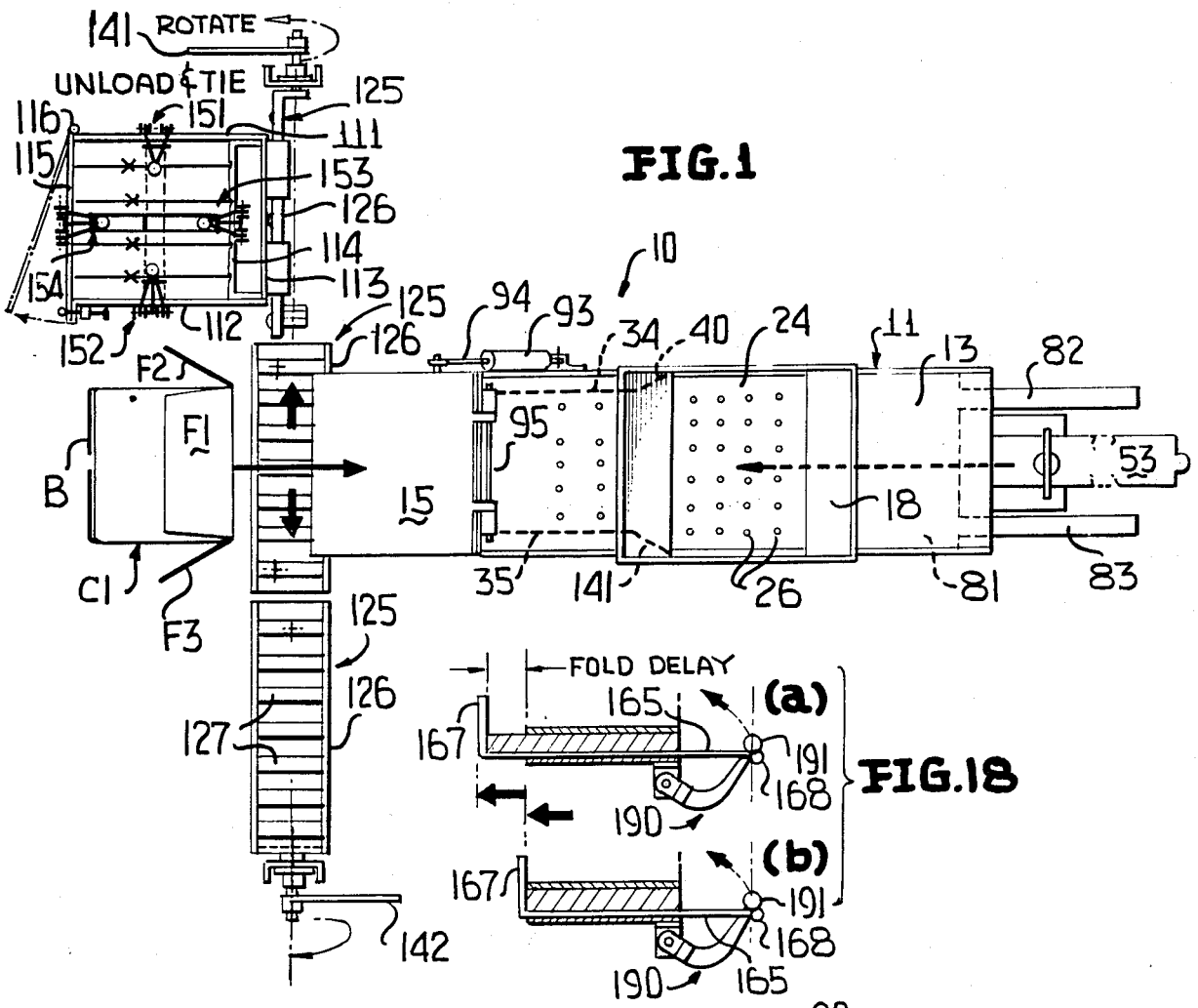
FIG.1
FIG.18
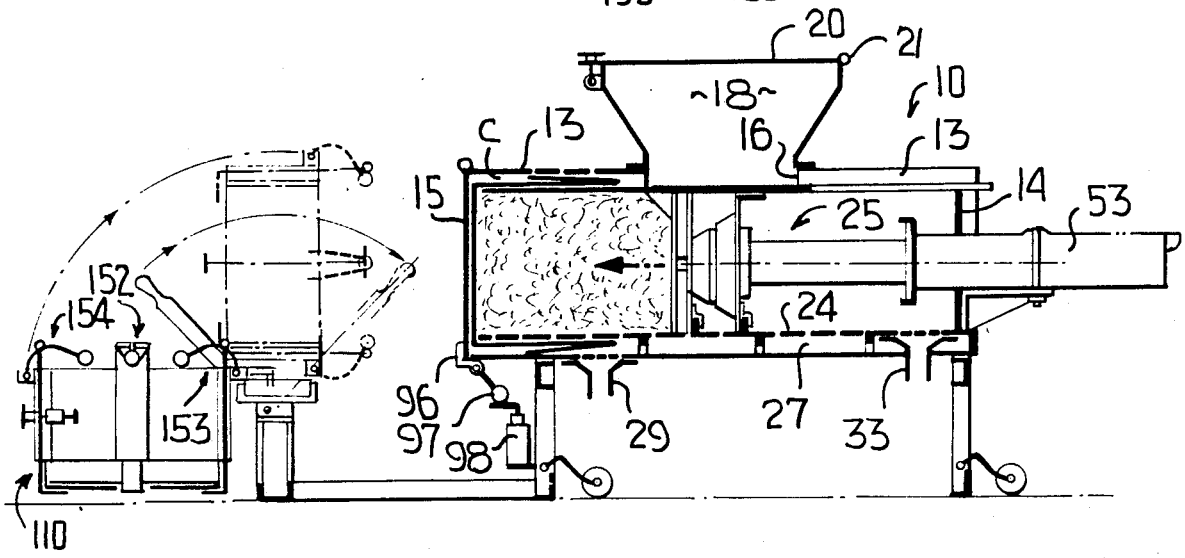
FIG.4

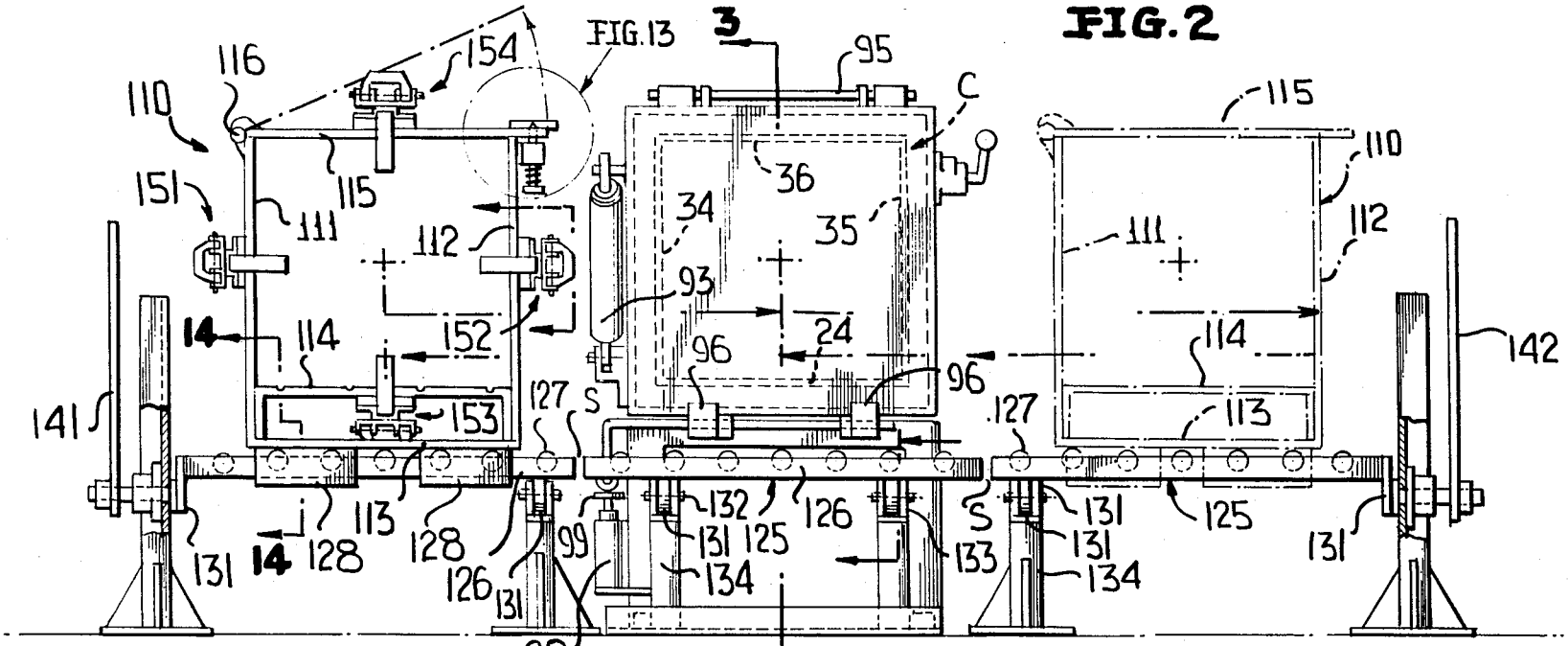
FIG.2
FIG.13
3
3
14
14
110
111
112
113
114
115
116
125
126
127
128
131
133
134
141
142
151
152
153
154
95
96
98
99
93
34
35
36
24
C
S
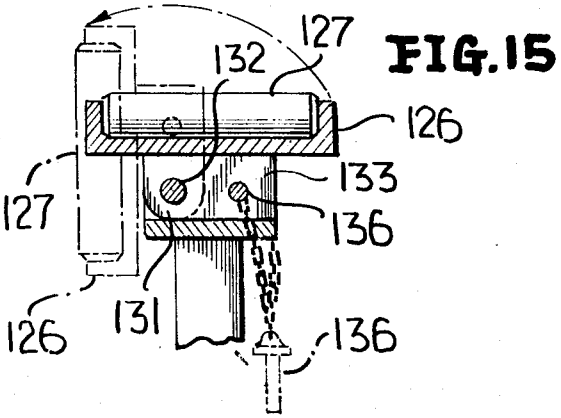
FIG.15
126
127
131
132
133
136
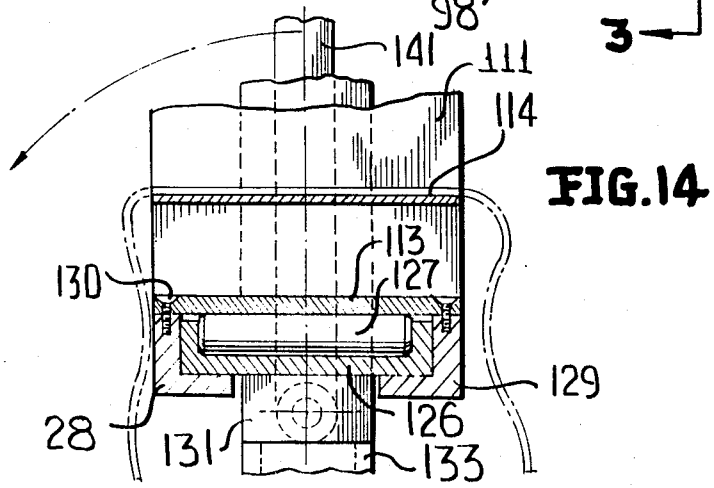
FIG.14
111
113
114
126
127
128
129
130
131
133
141

FIG.5
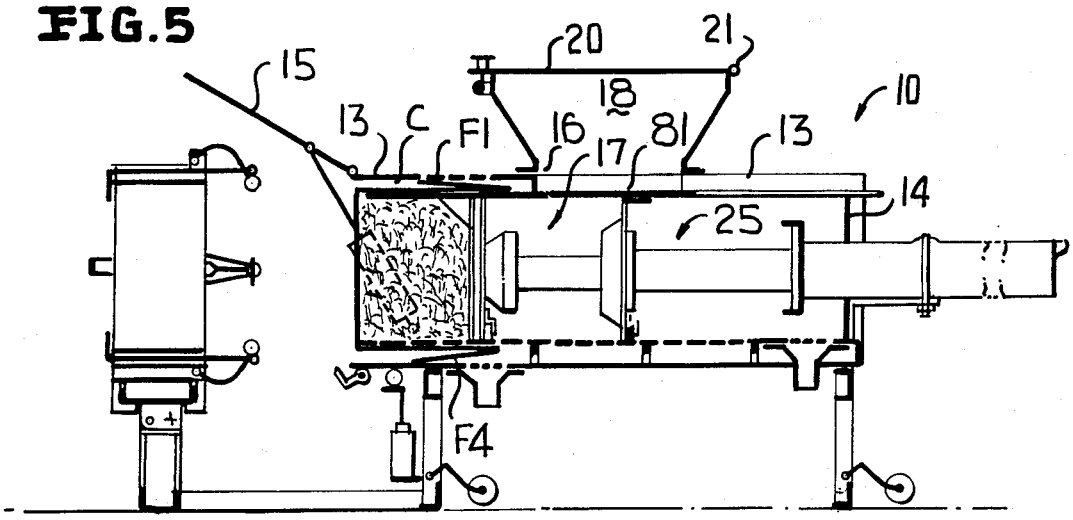
FIG.6
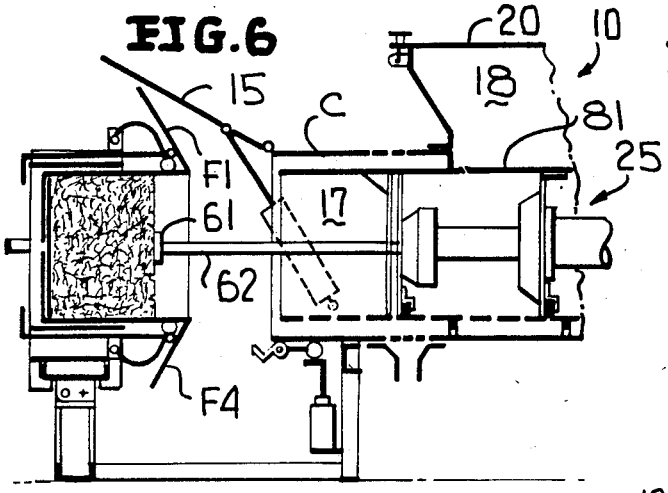
FIG.7
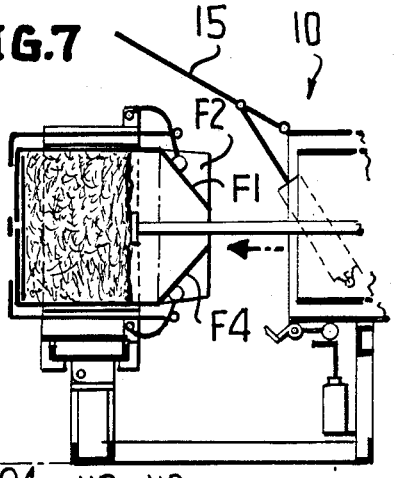
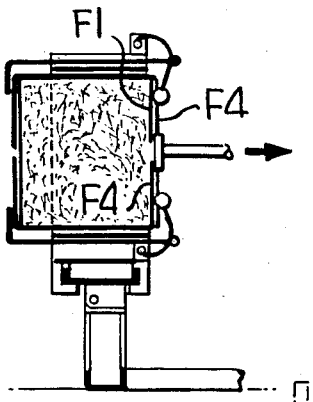
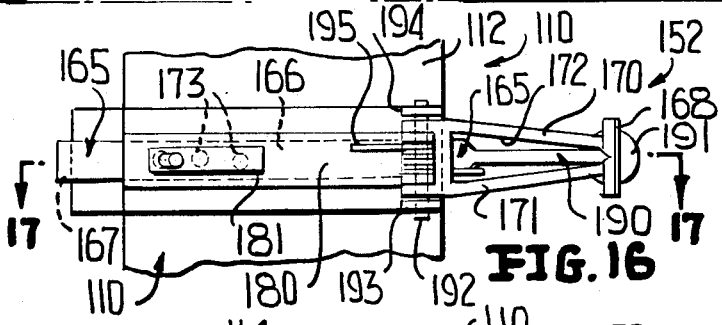
FIG.16
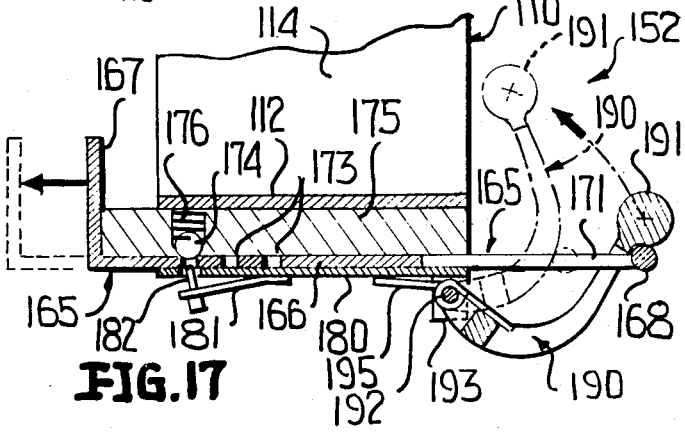
FIG.8
FIG.17

COMPACTING MACHINE

A primary object of this invention is to provide a novel compacting machine for compacting material in a carton having closure flaps folded exteriorly of the carton and toward a closed bottom thereof, the machine including a housing defining a generally elongated compacting chamber with a ram head reciprocal therein for compacting material into the carton and for discharging the carton from the compacting chamber, and means for folding the carton flaps toward a closed position during the discharge of the carton from the compacting chamber.

A further object of this invention is to provide a novel compacting machine of the type aforesaid wherein the folding means includes a plurality of pivotal fingers with each finger being located to contact an associated flap as the carton is discharged from the housing, a sliding element carried by each finger, each sliding element having opposite terminal end portions, a first of the terminal end portions being directed inwardly relative to a support upon which the carton is deposited upon discharge from the compacting chamber, and a second of the terminal end portions of each finger being in engagement with an associated finger for pivoting the same during the discharge movement of the carton to fold each carton flap to its closed position.

A further object of this invention is to provide a novel compacting machine of the type aforesaid wherein each sliding element includes a generally key-shaped portion which cooperates with the slot of an associated finger for folding each carton flap toward its closed position.

Still another object of this invention is to provide a novel compacting machine aforesaid wherein each carton and its associated compacted material is deposited within a tubular body having a pair of spaced horizontally disposed walls and a pair of spaced vertically disposed walls, and an upper of the horizontally disposed walls being pivoted to define a door for removing a carton and its associated compacting material from the tubular body.

Still another object of this invention is to provide a novel compacting machine of the type aforesaid wherein the tubular body is mounted for sliding movement in directions normal to an axis of the compacting chamber and is also mounted for pivoting movement about an axis similarly normal to the axis of the compacting chamber.

A further object of this invention is to provide a novel compacting machine of the type aforesaid wherein at least two such tubular bodies having horizontally disposed and spaced walls and vertically disposed and spaced walls are provided for relative sliding movement with respect to each other and with respect to the housing of the compacting machine such that the tubular bodies can be alternately positioned in alignment with the elongated compacting chamber for receiving therefrom a carton and the compacted material therein.

With the above and other objects in view that will hereinafter appear, the nature of the invention will be more clearly understood by reference to the following detailed description, the appended claims and the several views illustrated in the accompanying drawings.

IN THE DRAWINGS

FIG. 1 is a top plan view of a novel compacting machine constructed in accordance with this invention, and illustrates a housing defining a compacting chamber, a door thereof in its open position, and one of a pair of tubular bodies mounted for sliding and pivoting movement relative to the housing of the compacting machine.

FIG. 2 is an end view of the compacting machine looking from left-to-right in FIG. 1, and illustrates a tubular body for receiving a carton and its associated compacted material from the compacting chamber along with a plurality of fingers for automatically closing flaps of the carton upon its discharge from the compacting chamber.

Figure 3:
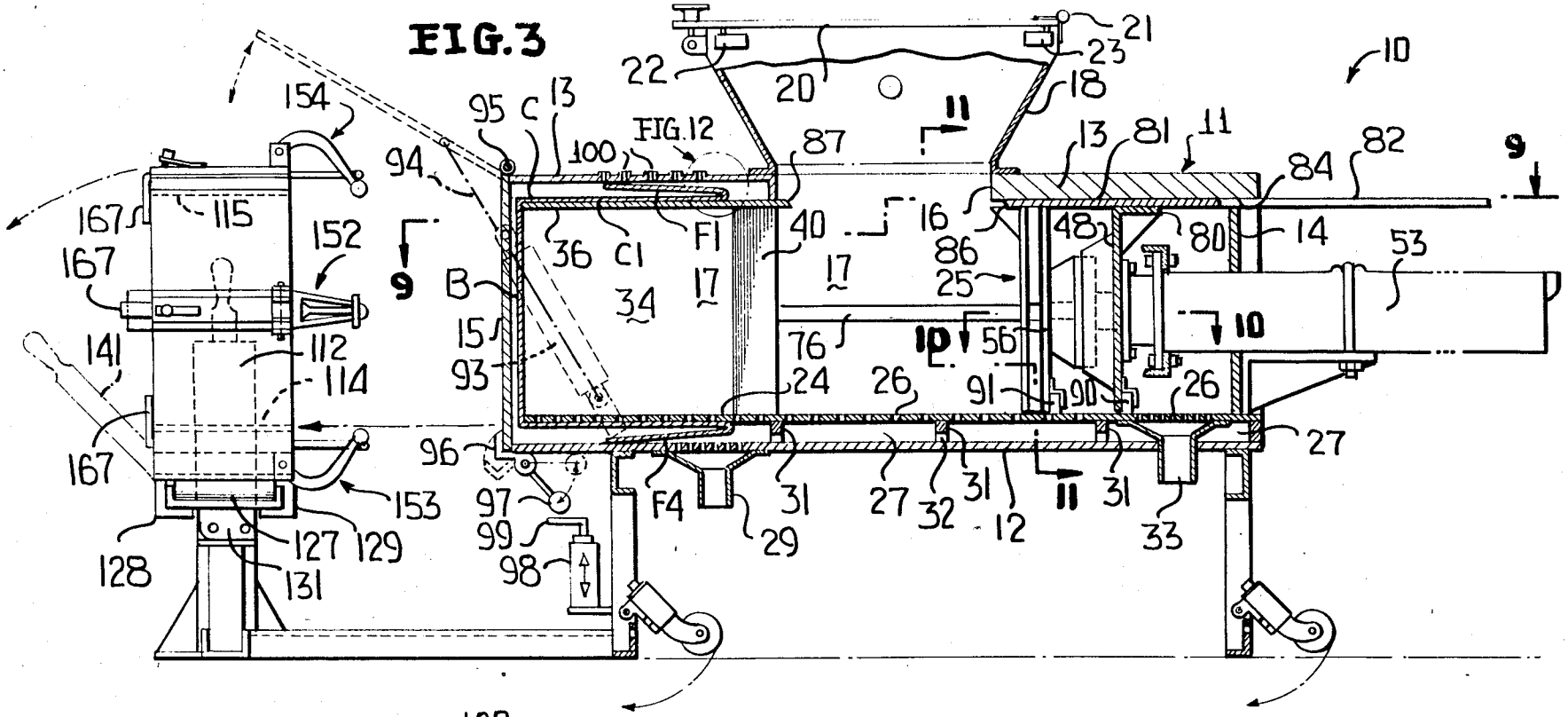

FIG. 3 is a sectional view taken generally along line 3—3 of FIG. 2, and illustrates a door or panel carried by a ram of the machine, a venturi-like passage into which the ram moves, a carton in external surrounding relationship to a portion of the compacting chamber downstream of the venturi-like passage, and one of the tubular bodies for receiving the carton and its associated compacted material.

FIG. 4 is schematic sectional view of the compacting machine, and illustrates the material being partially compacted by the ram with an entrance opening of the compacting chamber being closed by the panel carried by the ram.

FIG. 5 is a schematic sectional view similar to FIG. 4, and illustrates the position of a portion of the ram when the material is fully compacted within an associated carton and after a door of the housing has been open to permit the discharge of the carton and its associated compacted material therefrom.

FIG. 6 is a fragmentary sectional view similar to FIG. 5, and illustrates the manner in which the carton and its associated compact material is discharged from the compacting chamber into an associated tubular body.

FIG. 7 is a fragmentary sectional view similar to FIG. 6, and illustrates the manner in which the progressive leftward movement of the carton results in the automatic closing in the carton flaps by associated fingers.

FIG. 8 is a schematic sectional view similar to FIG. 7, and illustrates the finally folded or closed position of the carton flaps.

Figure 9:
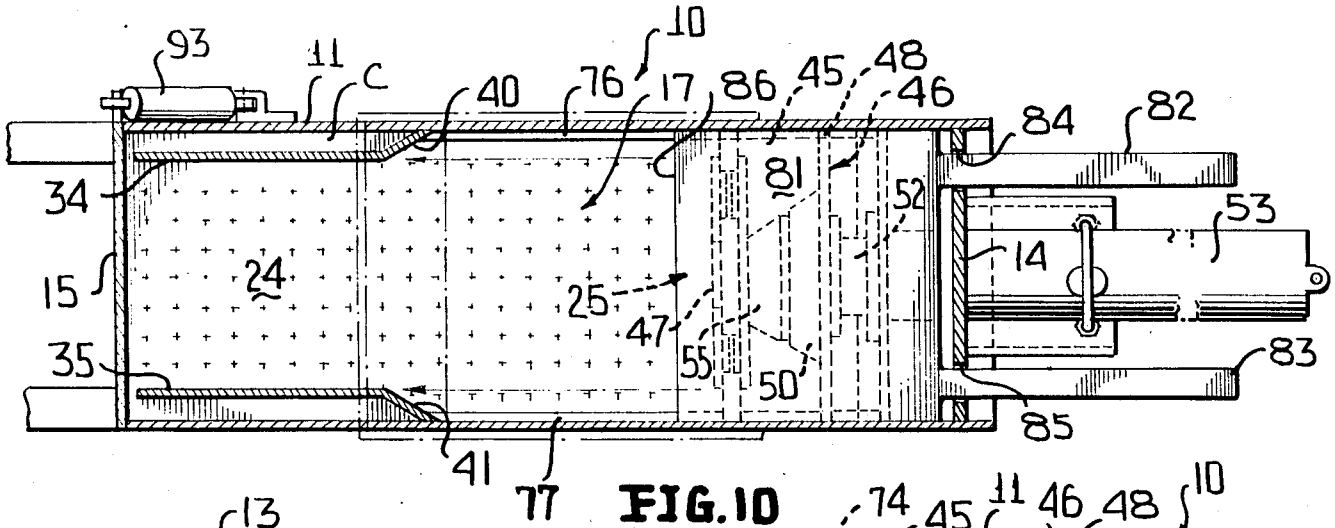

FIG. 9 is a cross-sectional view taken generally along 9—9 of FIG. 3, and illustrates details of a venturi-like passage in part defining a compacting chamber of a housing of the compacting machine.

Figure 10:
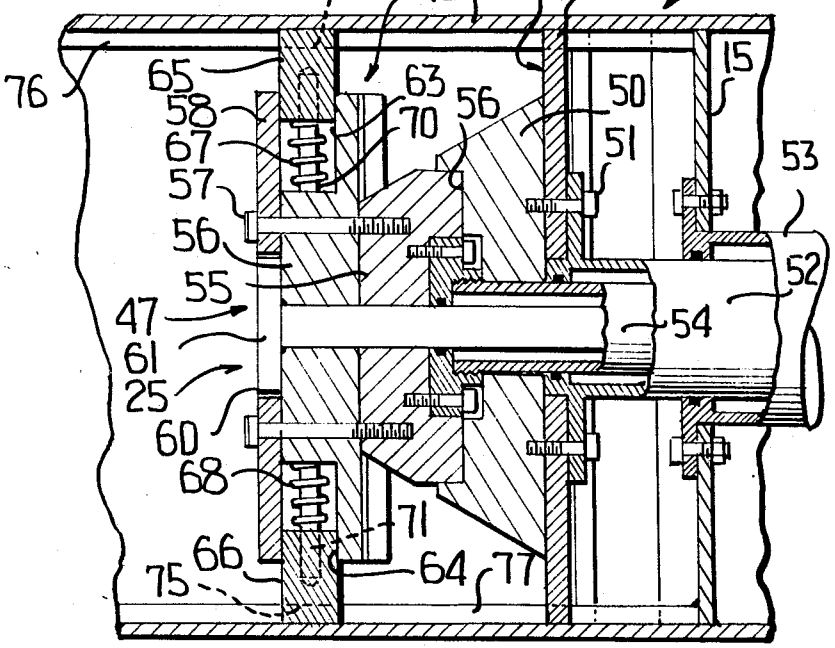

FIG. 10 is an enlarged fragmentary sectional view taken generally along line 10—10 of FIG. 3, and illustrates three coaxial rods carrying a pair of compacting ram heads and an associated carton ejector with one of the ram heads having spring-biased sides.

Figure 11:
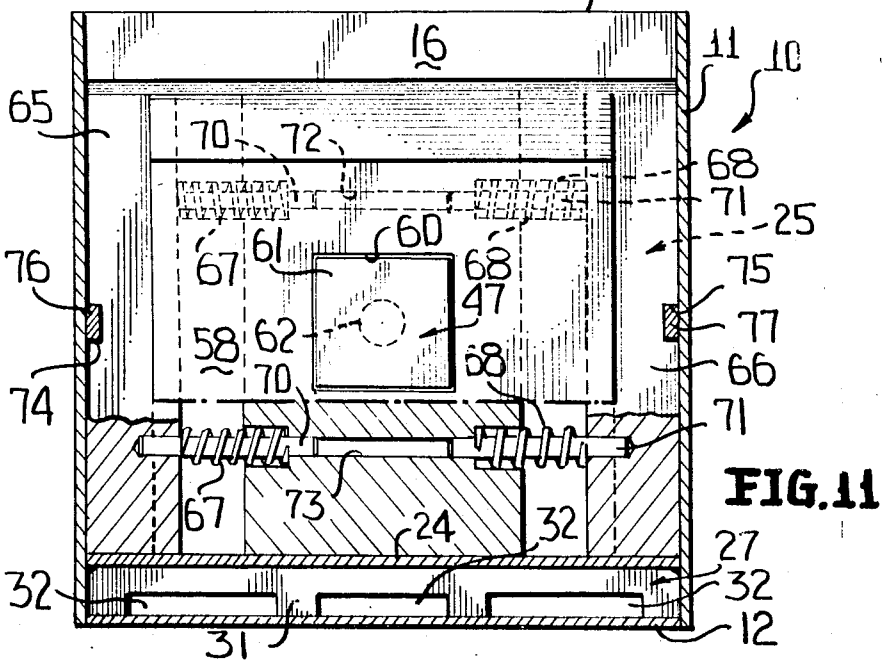

FIG. 11 is an enlarged sectional view taken generally along line 11—11 of FIG. 3, and illustrates a portion of the ram head in the manner in which the sides thereof are guided during the motion of the ram head in its compacting direction.

Figure 12:
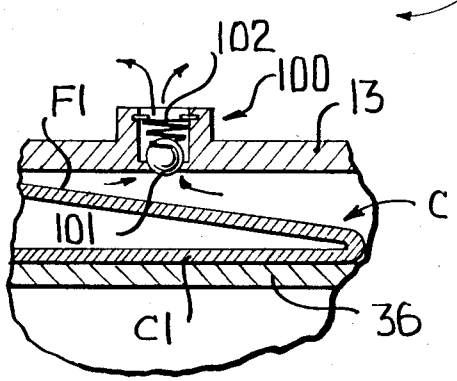

FIG. 12 is an enlarged fragmentary sectional view of the encircled portion of FIG. 3, and illustrates a spring biased venting valve which is opened during the compression cycle of the ram head.

Figure 13:
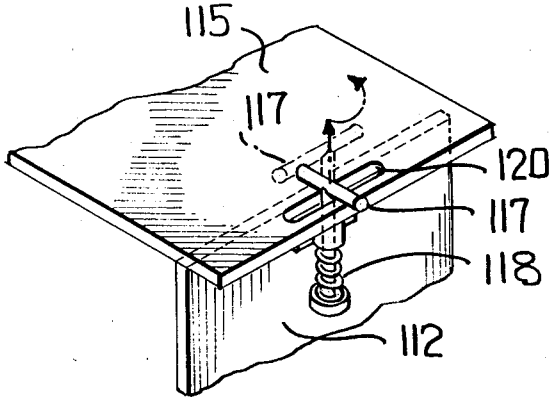

FIG. 13 is a fragmentary perspective view of the encircled portion of FIG. 2, and illustrates a locking mechanism for a horizontal upper wall or door of one of a pair of tubular bodies associated with the compacting machine.

FIG. 14 is an enlarged sectional view taken generally along line 14—14 of FIG. 2, and illustrates the manner in which one of the pair of tubular bodies is mounted for sliding movement relative to a pivotally mounted roller conveyor.

FIG. 15 is an enlarged sectional view taken generally along line 15—15 of FIG. 2, and illustrates the manner in which one of three roller conveyors can be pivoted between the solid and phanton outline positions.

FIG. 16 is an enlarged side elevational view taken generally along line 16—16 of FIG. 2, and illustrates one of four fingers associated with each of the tubular bodies for automatically folding the flaps of the carton to a closed position during the discharge of the carton from the compacting chamber.

FIG. 17 is a sectional view taken generally along line 17—17 of FIG. 16, and illustrates the manner in which one of the fingers is pivoted to a wall of the tubular body and a slide associated therewith for pivoting the finger from its solid to its phantom outline position upon the movement of the slide to the left, as viewed in FIG. 17, by the discharge motion of an associated carton.

FIG. 18(*a*) and (*b*) are fragmentary schematic views of two fingers similar to the finger of FIG. 16 and 17, illustrating the construction of the associated slides to effect a time delay in folding of associated carton flaps.

A novel compacting machine constructed in accordance with this invention is generally designated by the reference numeral 10, and includes a housing 11 defined by a bottom wall 12, a top wall 13, an end wall 14, and an opposite end wall or door 15. The top wall 13 is provided with a generally rectangular configured opening 16 (FIG. 3) through which material can be introduced into a compacting chamber 17 of the housing 11. A suitable hopper 18 is welded, bolted or otherwise secured to the wall 13 in overlying relationship to the opening 16 and carries a door 20 secured thereto by conventional hinges 21. Appropriate switches 22, 23 are carried by the hopper 18, and the switches 22, 23 are part of a circuit (not shown) for energizing a fluid motor for operating ram means 25. The unillustrated circuit will effect the operation of the ram means 25 only upon deactivation of both of the switches 22, 23 which is an indication that the door 20 is completely closed, and at any time that the door 20 is opened, the latter-noted circuit can not be energized and, thus, the ram 25 can not move in a material-compacting direction which is from right-to-left, as viewed in FIGS. 3 and 9. Thus, by the utilization of the switches 22, 23 it is assured that a person can not be injured by, for example, the ram means or ram head 25 moving from the position shown in FIG. 3 to the left thereof while one's hand, fingers or the like are disposed within the compacting chamber 17.

The compacting chamber 17 is further defined by a false bottom or bottom wall 24 having a plurality of apertures 26 through which liquid might flow from the material being compacted during the compacting operation. The liquid flows through the apertures 26 and into an area 27 beneath the wall 24 and eventually through apertures 28 in the bottom wall 12 to an appropriate conduit 29 which is in turn connected to a drain (not shown). The false bottom 24 is supported from the wall 12 by a plurality of braces 31, some of which have slots or openings 32 so that liquid anywhere within the chamber 27 can be drained through the apertures 28 into the conduit 29. If desired, some of the apertures 26 may be connected or placed in fluid communication with another conduit 33 for conducting liquid directly to a drain without collecting thereof in the chamber 27.

The compacting chamber 17 is additionally defined by a pair of upright or vertical walls 34, 35 (FIG. 2) and a horizontal wall 36 above and generally parallel to the wall 24. The walls 24 and 34 through 36 define a generally rectangular annular chamber C with the exterior of the housing 11 and within the chamber C is located a carton C1 having flaps F1 through F4 and a bottom B. The flaps F1 through F4 are folded exteriorly of the carton C1 and in a direction toward the bottom B, as is readily apparent in FIG. 3. As will be more readily apparent hereinafter, material deposited into the compact chamber 17 through the opening 16 will move to the left as the ram means 25 is moved in the same direction, as is viewed in FIG. 3, and will thus be introduced into that portion of the compacting chamber 17 defined by the walls 34 through 36 and the coextensive portion of the bottom wall 24 (FIGS. 4 and 5). In order to efficiently introduce the material into the latter-defined area, the vertical walls 34, 35 are provided with respective venturi-like passages or walls 40, 41 (FIG. 9) which converge in a direction from right-to-left, as viewed in FIG. 9.

Reference is now made specifically to FIGS. 9 through 11 in which the ram means 25 are more specifically illustrated and include a ram head defined by a ram head portion 45, a ram head portion 46, and an ejector 47.

The ram head portion 46 includes a generally rectangular plate 48 carrying a bull head or weight 50 and being connected by bolts 51 to a rod 52 of a fluid motor or cylinder 53. The cylinder or fluid motor 53 is connected to the end wall 14 of the housing 11, as is best illustrated in FIG. 10. Another rod 54 is connected to a bull head 55 of the ram head portion 45 and the rod 54 is in turn reciprocated by an appropriate piston (not shown) in the cylinder or fluid motor 53. The bull head 55 is seated within a rectangular recess 56 of the bull head 50. The bull heads 50, 55 merely add weight or mass to the overall ram means 25 to effect the efficient compacting of the material within the compacting chamber 17.

The ram head portion 45 further includes a generally rectangular plate 56 connected to the bull head 55 by bolts 57 with the plate 56 being sandwiched between the bull head 55 and another plate 58 having a circular or rectangular opening 60 receiving an ejector head 61 of the ejector means 47 which in turn includes another rod 62 operated in turn by its piston (not shown). The plate 56 includes two vertically relieved portions or slots 63, 64 within which are slidably mounted respective slides 65, 66 spring biased away from the longitudinal axis (unnumbered) of the various rods 52, 54 and 53 by suitable springs 67, 68 surrounding rods 70, 71 which are affixed to the sides 65, 66, respectively, but are slidably received in apertures or bores 72, 73 of the plate 56. The sides 65, 66 are normally fully extended by the respective springs 67, 68, as is best illustrated in FIGS. 10 and 11, but as the ram head portion 45 moves into the venturi-like passage defined by the walls 40, 41, the sides 65, 66 are urged toward each other and against the bias of the springs 67, 68 by the converging relationship of the walls 40, 41. During this same movement from right-to-left, as viewed in FIGS. 9 and 10 of the drawings, the sides 65, 66 are guided during their movement and are prevented from cocking by traveling with slots 74, 75 thereof riding on guide rods 76, 77 secured to side walls (unnumbered) of the housing 11, as is best illustrated in FIG. 11.

The ram head portion 46 and specifically the plate 48 thereof has an upper flange 80 (FIG. 3) to which is welded or otherwise secured a generally rectangular horizontally disposed door or panel 81 (FIG. 9) having an overall size generally corresponding to the size, as well as to the shape, of the opening 16. The door or panel 81 has two generally parallel guide rods 82, 83 projecting through and guided by respective apertures or openings 84, 85 in the end wall 14 of the housing 11. Thus, as the ram means 25 is moved from right-to-left, as viewed in FIGS. 3 and 9, the door or panel 81 carried by the plate 48 is moved to the position shown best in FIG. 5 at which the door or panel 81 closes the opening 16 with a leading tapered edge 86 (FIG. 3) of the door or panel 81 in contact with a tapered edge 87 of the upper generally horizontally disposed wall 36 (FIG. 3).

Preferably, though not necessarily, the plates 48 and 56 carry rubber, plastic or like squeegees 90, 91 (FIG. 3) along bottom edges thereof for scraping or sweeping the liquid (water or like) into the openings 26 during the reciprocal movement of the ram means 25.

The door 15 (FIGS. 2 and 3) is preferably opened by a fluid motor which includes a cylinder 93 pivotally connected to the housing and a rod 94 pivotally connected to the door 15 with the door 15 being hinged, as at 95, to the upper wall 13, as is best illustrated in FIGS. 2 and 3 of the drawings. The door 15 is normally held in its closed position (solid outline in FIG. 3) by means of a pivoting latch 96 having a weighted arm 97 which under the influence of gravity normally urges the latch to its locked solid position shown in FIG. 3. However, through a suitable hydraulic or electrically operated switch 98, an arm 99 of the latter can be moved upwardly from the solid position shown in FIG. 3 resulting in the counter-clockwise pivoting and, thus, the unlatching of the latch 96 to permit the opening of the door 15 under the influence of the appropriately conventionally powered cylinder 93 and rod 94 associated therewith.

During the movement of the ram means 25 from right-to-left, again as viewed in FIG. 3, any air which might be entrapped within the compacting chamber 17 after the door 81 has closed can be vented to atmosphere through one or more of a plurality of relief valves 100 (FIGS. 3 and 12) disposed in the top wall 13 of the housing 11. The relief valves 100 are simply ball valves or ball elements 101 biased by captive springs 102 to a closed position, as shown in FIG. 12. However, should pressure increase during a compacting operation, the air acting on one or more of the ball elements 101 will raise the same against the bias of the associated springs 102 to vent the interior of the chamber C to atmosphere.

Once a carton has been filled with compacted material, the same is discharged upon and within a generally tubular body 110 defined by a pair of side walls 111, 112 in upright spaced relationship, a bottom wall 113, a false bottom wall 114 spaced above the wall 113, and an uppermost horizontal wall or door 115 pivoted by hinges 116 to the wall 111 (FIG. 2). The wall or door 115 can be held closed by means of a conventionally spring-biased locking latch having a T-shaped stem 117 (FIG. 13) which is normally biased in a downward direction by a spring 118 and which can be moved in and out of a slot 120 of the door or wall 115, in the manner readily apparent in FIG. 13 to hold the door or wall 115 locked relative to the vertical side wall 112 or otherwise permit the door 115 to be opened when the lock 117 is moved from the solid to the phantom outline position shown in FIG. 13.

The tubular body 110 is one of two such bodies mounted for sliding movement upon three identical supports or roller conveyors 125. The other tubular member corresponding to the tubular member 110 is not shown simply for clarity, but will be described more fully hereinafter relative to the operation of the compacting machine 10. Each of the supports 125 is identical and includes a generally upwardly opening channel 126 having suitably rotatably mounted therein a plurality of rollers 127 which engage the underside of the bottom wall 113 of the tubular body 110. A pair of angle irons or right angled brackets 128, 129 (FIG. 14) are connected to the underside of the bottom wall 113 by suitable screws 130 and the distance between the opposing edges (unnumbered) of the angled irons 128, 129 is sufficient to permit the same to pass through downwardly projecting lugs 131 carried by each support 126 and pivotally connected by pivot pins 132 to upwardly projecting lugs 133 of vertical supports 134. Thus, due to the spacing between the angle irons or angle bars 128, 129 (FIG. 14), each of the two tubular bodies 110 can slide the entire length of the supports 125 from left-to-right or right-to-left, as viewed in FIG. 2, across the spaces or gaps S, S between adjacent supports 125, as will be described more fully hereinafter. Stated otherwise, the tubular body 110 can move or slide along the support with which it is associated in FIG. 2 to the right across the first gap S and upon the middle support 126 directly adjacent the door 15 and thence move across the next gap 5 to the right upon the last support 125 to the right in FIG. 2 and, of course, return in an opposite direction to the position it is shown in this same figure. Furthermore, due to the pivots 132, the three supports 125 may pivot from the position shown in FIGS. 2 and 3 and the solid outline position in FIG. 15 to the phantom outline position shown in FIG. 15 and the solid outline positions shown in FIGS. 1 and 4 for unloading a carton from the tubular bodies 110, as will be described more fully hereinafter. However, to preclude accidental pivoting of the supports 125, a lock pin 136 (FIG. 15) is insertable into aligned openings (unnumbered) in the ears, lugs or brackets 131, 133. When the pin 136 is thus inserted in the aligned openings of the ears or brackets 131, 133, then each channel 126 will be locked in its horizontal position (FIG. 15) but when the pins 136 are withdrawn, the channels can pivot about the respective pivot pins 132 to the phantom outline position shown in FIG. 15 and, thus, pivot the associated tubular body 110 to the solid outline position shown in FIGS. 1 and 4.

Suitable handles 141, 142 (FIG. 2) are connected to the endmost supports 125, since these are pivoted more often than the central support 125 which may not be pivoted at all, again as will be described more fully hereinafter.

Since the flaps F1 through F4 of the carton C1 are folded toward the bottom B (FIG. 3) during the compacting operation and while the carton is being discharged into the associated tubular body 110 (FIGS. 5 and 6), it is desired in keeping with this invention to automatically fold the flaps F1 through F4 from the folded position shown in FIG. 3 to the closed position shown in FIG. 8 during the discharge of the carton C1 and its compacted material from the compacting chamber 17 of the machine 10 into the tubular body 110. The means for effecting the folding of the flaps F1 through F4 is a plurality (four) means in the form of fingers or finger folding means 151 through 154 associated with the respective walls 111, 112, 114 and 115, respectively, of the tubular body 110. Since the folding means or finger folding means 151 through 154 are identical, the following description which applies to the folding means 152 (FIGS. 16 and 17) is equally applicable to the folding means 151, 153 and 154.

Reference is made to FIGS. 16 and 17 in which the finger means 152 is shown suitably secured to the vertical wall 112 of the tubular body 110. The flap folding means 152 includes an elongated sliding element 165 having a central portion 166, an inwardly directed terminal end portion 167 and an opposite terminal end portion 168 in the form of a cross bar and a pair of legs 170, 171 which set off therebetween a slot 172 converging to the right, as viewed in FIG. 16. The central portion 166 of the sliding element 165 includes a plurality of openings 173 which can receive a locking ball 174 carried by a body 175 with the locking ball 174 being biased toward the apertures 173 by a spring 176 (FIG. 17). The central portion 166 of the sliding element 165 is slid in a chamber (unnumbered) defined by the main body 175 and a covering plate 180 carrying a flexible finger 181 which has a nose 182 movable into an associated opening (unnumbered) and anyone of the openings 173 for disengaging the locking ball 174 from the openings 173. A folding finger 190 passes through the slot 172 and has an enlarged head 191 at one end, and an opposite end is pivotally secured by a pivot pin 192 to a pair of ears 193, 194 of the main body 175. A spring 195 normally biases the finger 190 to the solid position shown in FIGS. 16 and 17. This same solid position of the finger 190 shown in FIG. 17 is also shown in FIGS. 5 through 8 of the drawings.

Referring first to FIG. 5, as the carton C1 and the compressed material therein is moved to the left by the ejector head 61 of the ejector means 47 and enters the tubular body or member 110, the flaps F1 through F4 will spring outwardly under their natural resilience (FIG. 6) and at this point (FIG. 6), the bottom B of the carton C1 has not yet contacted, engaged or moved any of the terminal end portions 167. However, as the carton C1 moves further to the left from the position shown in FIG. 6, the enlarged head 191 associated with the various fingers 190 will engage the flaps F1 through F4 and begin the folding thereof toward a closed position (FIG. 7), and simultaneously therewith the bottom B of the carton C1 will engage the terminal end portions 167 of the various sliding elements 165 and move the same from the solid to the phantom outline position shown in FIG. 17. This motion of the sliding elements 165 results in the cross bar 168 of each sliding element pivoting each finger 190 against the bias of its associated spring 195 (FIG. 17) to move each finger from the solid to the phantom outline position shown in the latter-noted figure resulting in the inward folding of the various flaps F1 through F4 toward and to the closed position shown in FIG. 8. Obviously, since two of the flaps which oppose each other in one pair must move to their closed position prior to the next pair of flaps moving toward the closed position, the terminal end portions 167 of the various flap folding means 151 through 154 are positioned different distances along the path of movement of the carton C1, as is most evident from FIG. 18 to which attention is now directed. FIG. 18(*b*) illustrates a terminal end portion 167 which will be contacted and moved before a terminal end portion 167 of FIG. 18(*a*). Thus, the folding means 151, 152 are preferably positioned with their terminal end portion shown as in FIG. 18(*b*), while the folding means 153, 154 are positioned with their terminal ends as shown in FIG. 18 (*a*). Thus, in this fashion as the carton C1 moves into the tubular body 110, the fingers 167 of the folding means 151, 152 will be first moved to the left resulting in the side flaps of the carton C1 being closed after which the fingers 167 of the folding means 153, 154 will be contacted to cause the upper and lower flaps of the carton C1 to be folded toward their closed position. Thereafter, the ejector head 47 may be retracted, the door 15 closed and the tubular member 110 moved to an out of the way position (FIG. 2) for subsequent unloading during which time another (unillustrated) tubular member 110 can be moved in position in line with the door 15 for subsequent unloading thereinto. While the first carton can be unloaded from the tubular body 110, in the matter shown in FIG. 1, by simply rotating or pivoting the support to a position at which the bottom B of the carton rests upon the ground (FIG. 4, and can be securely closed and tied, the door 115 is opened (FIG. 1), and a carton earlier inserted in the chamber 17 with material compacted therein is removed for subsequent disposal, and the operation of the machine 10 thus repeated.

From the foregoing, it will be readily apparent that once the material is placed within the compacting chamber 17, the ram means 25 moves progressively from right-to-left to first introduce the material through the venturi-like passages 40, 41 and compress the same against the carton bottom B and the closed door 15 and within the area defined by the walls 34, 35, 36 and the underlying portion of the wall 24. Thereafter, with the door 15 in its open phantom outline position (FIG. 3), the continued right-to-left motion of the piston associated with the rod 62 ejects the carton C1 and its compacted material into whichever of the two tubular members 110 is in alignment with the axis of the compacting chamber 17 and, of course, is upon the central support 126 with the axis of the tubular body 110 coincident with the axis of the compacting chamber of the housing 11. Thereafter, the container or carton C1 and its compacted material is inserted into the axial aligned tubular body 110 in the manner earlier described, resulting in the progressively folding of the various flaps F1 through F4, as illustrated in FIGS. 6 through 8, after which the tubular body 110 with the carton C1 therein can be moved to the leftmost position (FIG. 2) and pivoted to an unloading position (FIGS. 1 and 4) at which time the axis of the tubular member 110 is vertical or in the solid outline position shown in both FIGS. 1 and 4. After the tubular body 110 has been moved from the position at which its axis is aligned with the axis of the compacting chamber 17 and off the central support 126, the other tubular body 110 (not shown) which was resting atop the right-handmost support 125 in FIG. 2 is now moved to the left upon the central support 126 with its axis in alignment with the axis of the compacting chamber and while the compacting operation is proceeding, the same operator can unload the first compacted carton (FIGS. 1 and 2) by opening the door 15 (FIG. 1), reclosing the door and returning by pivoting the tubular body 110 to its upright position on the leftmost support (FIG. 2). Thereafter, the compacting operation which proceeded during the unloading operation is virtually terminated and the second formed carton and its compacted material can be discharged in the manner heretofore described into the second tubular body 110 (not shown) in the manner heretofore described, shifted or slid to the right, as viewed in FIG. 2, and the tubular body 110 shown in FIG. 2 again moved upon the central support 126 for the performance of another compacting operation. This process is continuously repeated as is necessary.

Although only a preferred embodiment of the invention has been specifically illustrated and described herein, it is to be understood that minor variations may be made in the apparatus without departing from the spirit and scope of the invention, as defined in the appended claims.

I claim:

1. A compacting machine for compacting material in a carton having closure flaps comprising a housing defining a generally elongated compacting chamber, means movable along a first path of travel for compacting material within a carton housed within said compacting chamber with flaps of the carton being folded externally of the carton, means movable along a second path of travel generally coincident with and in the same direction as said first path of travel for discharging and further moving the carton from the compacting chamber, means for folding the carton flaps to a closed position after the discharge of the carton and during its further movement along the second path of travel from the compacting chamber by said discharging means, said support means being disposed for receiving each carton discharged from the compacting chamber, said folding means including a plurality of fingers pivotally carried by said support means with each finger being located to contact an associated flap as the carton is received upon said support means, and means slidably carried by said support means and contactable by a closed end of the carton during the receipt of the carton upon the support means for pivoting each finger from a position externally of the carton and adjacent a peripheral wall thereof to a position overlying an end of the carton.

2. The compacting machine as defined in claim 1 wherein said slidable means includes a sliding element associated with each finger, each sliding element having opposite terminal end portions, a first of said terminal end portions being directed inwardly relative to said support means for contact by the closed end of the carton, and a second of said terminal end portions being in engagement with an associated finger for pivoting the same to the position overlying the carton end to fold an associated carton flap closed.

3. The compacting machine as defined in claim 2 including spring means for normally biasing each finger in a direction toward its position adjacent a peripheral wall of the carton.

4. The compacting machine as defined in claim 2 wherein each of said second terminal end portions is of a T-shaped configuration defined by a leg and a cross arm, each finger includes an opening therein, and each leg being in sliding relationship to an associated finger opening and with the cross arm in sliding bearing engagement with an associated finger.

5.. The compacting machine as defined in claim 2 including means for releasably locking each sliding element in a plurality of positions.

6. The compacting machine as defined in claim 2 wherein each finger is of a curved configuration.

7. The compacting machine as defined in claim 4 wherein each finger is of a curved configuration, each opening is an elongated slot, and each finger includes a first end pivoted to said support means and a second terminal end of a ball-shaped configuration.

8. A compacting machine for compacting material comprising a housing defining a generally elongated compacting chamber, said chamber having axially opposite ends, one of said ends being closed by a movable door, a ram head within said compacting chamber, means for moving said ram head from a first position remote from said door to a second position more adjacent said door thereby compacting material deposited within said compacting chamber, means defining a venturi-like passage for said ram head disposed between said first and second positions, said venturi-like passage decreasing in size in a direction of ram head movement, and said ram head having at least one relatively slidable side which moves generally normal to the direction of ram head movement as the ram head moves progressively into and out of said venturi-like passage, said ram head including first and second relatively movable ram head portions, said ram head portions each being carried by an individual piston rod in part defining said ram head moving means, and said piston rods being in coaxial relationship to each other.

9. The compacting machine as defined in claim 8 including a space between said housing and said venturi-like passage for receiving therein a carton with the flaps thereof folded externally of the carton and projecting toward said door whereby material is compacted by said ram head within the carton, said ram head moving means also moving one of said ram head portions to a third position beyond said second position to discharge the carton from the compacting chamber when the door is open, and means for folding the carton flaps to a closed position after the discharge of the carton from the compacting chamber and during its further movement.

10. The compacting machine as defined in claim 8 including guide means internally of said housing cooperative with said ram head side for guiding said ram head during its movement from said first position toward said second position.

11. The compacting machine as defined in claim 8 including an opening in a top wall of said housing through which material to be compacted is deposited into said compacting chamber, a panel for closing said opening, and said panel being carried by said ram head.

12. The compacting machine as defined in claim 8 wherein said first ram head portion is movable by said moving means further toward said one chamber end than said second ram head portion, an opening in a top wall of said housing through which material to be compacted is deposited into said compacting chamber, a panel for closing said opening, and said panel being carried by said second ram head portion.

13. The compacting machine as defined in claim 8 wherein said first ram head portion is movable by said moving means further toward said one chamber end than said second ram head portion, an opening in a top wall of said housing through which material to be compacted is deposited into said compacting chamber, a panel for closing said opening, said panel being carried by said second ram head portion, said panel carrying a pair of guide rods, and said guide rods being guided in guide openings of said housing.

* * * * *